US007833010B2

(12) United States Patent
Baker et al.

(10) Patent No.: US 7,833,010 B2
(45) Date of Patent: Nov. 16, 2010

(54) NATURAL GAS INJECTION SYSTEM FOR REGENERATIVE THERMAL OXIDIZER

(75) Inventors: Robin J. Baker, Cary, IL (US); Bradley L. Ginger, Glenview, IL (US)

(73) Assignee: Eisenmann Corporation, Crystal Lake, IL (US)

( * ) Notice: Subject to any disclaimer, the term of this patent is extended or adjusted under 35 U.S.C. 154(b) by 1187 days.

(21) Appl. No.: 11/262,135

(22) Filed: Oct. 28, 2005

(65) Prior Publication Data

US 2006/0093975 A1 May 4, 2006

Related U.S. Application Data

(60) Provisional application No. 60/623,202, filed on Oct. 29, 2004.

(51) Int. Cl.
*F23G 7/06* (2006.01)
*B01D 53/06* (2006.01)

(52) U.S. Cl. ..... 431/50; 110/210; 110/211; 110/212; 432/72; 432/180; 431/10; 431/31

(58) Field of Classification Search ..... 431/5, 431/10, 31; 432/72, 180; 110/210, 211
See application file for complete search history.

(56) References Cited

U.S. PATENT DOCUMENTS 2,195,431 A 4/1940 Shively et al.
2,592,508 A 4/1952 Phyl
2,937,709 A 5/1960 De Seversky
3,124,437 A 3/1964 Lagarias
3,248,857 A 5/1966 Weindel et al.
3,330,778 A * 7/1967 Irvin ..... 502/31
3,765,154 A 10/1973 Hardt et al.
3,831,351 A 8/1974 Gibbs et al.
3,958,958 A 5/1976 Klugman et al.
3,994,663 A * 11/1976 Reed ..... 431/5
4,049,399 A 9/1977 Teller
4,072,477 A 2/1978 Hanson et al.
4,280,416 A * 7/1981 Edgerton ..... 110/254
4,355,108 A 10/1982 Gaddy et al.

(Continued)

*Primary Examiner*—Steven B McAllister
*Assistant Examiner*—Nikhil Mashruwala
(74) *Attorney, Agent, or Firm*—Drinker Biddle & Reath LLP

(57) ABSTRACT

The present invention provides a system and method for injecting natural gas in an RTO. The RTO may be, for example, a known type that has a rotary distributor, a center section divided into pie-shaped segments above the rotary distributor, a heat exchanger section above the center section, and a combustion chamber above the heat exchanger. According to an aspect of the invention, the system introduces gas into segments of the center section in a sequenced manner via cycling on/off control valves. In a particular embodiment, the natural gas is injected at a specific location of a respective segment within the center section that is past the rotary distributor seals and directly under the bottom of the heat exchanger bed. According to the injection sequence, the injection of natural gas into the segment commences when the segment begins to receive inlet waste gas streams, and injection ceases before the flow through the sector changes or stops. In an embodiment, each injection cycle may last a predetermined time to preferably achieve a constant flow of natural gas in the intake stream of process air as the rotary distributor delivers such flow sequentially among the segments.

19 Claims, 7 Drawing Sheets

U.S. PATENT DOCUMENTS 4,523,928 A 6/1985 Hillman et al.
4,844,723 A 7/1989 Tellini et al.
4,850,862 A 7/1989 Bjerklie
4,870,045 A 9/1989 Gasper et al.
5,016,547 A * 5/1991 Thomason ..... 110/211
5,084,072 A 1/1992 Reynolds
5,154,734 A 10/1992 Yung
5,516,499 A * 5/1996 Pereira et al. ..... 423/245.3
5,562,442 A 10/1996 Wilhelm
5,589,142 A 12/1996 Gribbon
5,624,476 A 4/1997 Eyraud
5,664,942 A * 9/1997 Bayer ..... 431/7
5,700,443 A 12/1997 Yamamoto et al.
5,871,349 A 2/1999 Johnson et al.
5,967,771 A * 10/1999 Chen et al. ..... 432/180
6,117,403 A 9/2000 Alix et al.
6,132,692 A 10/2000 Alix et al.
6,193,782 B1 2/2001 Ray
6,224,653 B1 5/2001 Shvedchikov et al.
6,294,003 B1 9/2001 Ray
6,298,877 B1 * 10/2001 Inuki et al. ..... 137/625.11
6,558,454 B1 5/2003 Chang et al.
6,649,132 B1 11/2003 Hwang et al.
7,270,698 B2 9/2007 Tanaka et al.
7,297,182 B2 11/2007 Ray et al.
7,318,857 B2 1/2008 Ray et al.
7,332,020 B2 2/2008 Tanaka et al.
2002/0061270 A1 5/2002 Osborne
2002/0164730 A1 11/2002 Perdices et al.
2004/0040438 A1 3/2004 Baldrey et al.
2004/0121436 A1 6/2004 Blount
2005/0112056 A1 5/2005 Hampden-Smith et al.
2005/0137443 A1 * 6/2005 Gorawara et al. ..... 585/823
2005/0220695 A1 10/2005 Abatzoglou et al.
2007/0079704 A1 4/2007 McAnespie

* cited by examiner

NATURAL GAS INJECTION SYSTEM FOR REGENERATIVE THERMAL OXIDIZER

CROSS-REFERENCE TO RELATED APPLICATIONS

This patent application claims the benefit of U.S. Provisional Patent Application No. 60/623,202, filed Oct. 29, 2004.

FIELD OF THE INVENTION

This invention generally relates to regenerative thermal oxidizers (RTOs) and more particularly relates to a natural gas injection system for an RTO.

BACKGROUND OF THE INVENTION

A regenerative thermal oxidizer is used to clean polluted waste gas from an industrial process. Conventional RTOs are disclosed, for example in U.S. Pat. Nos. 5,562,442 and 5,700,443, which are incorporated herein by reference.

An RTO is constructed to receive polluted waste gases from an industrial process, cleanse the gas, and permit cleansed gas to exit the RTO to the environment. The RTO includes a lower section having an inlet to receive incoming waste gas that is polluted or contaminated, and a centrally positioned rotary distributor in the lower section that is used in controlling gas flow via a segmented center section. The rotary distributor is substantially smaller than the lower section and is of a substantially smaller cross section.

When in operation, incoming polluted gas is directed to a middle section segment or segments. The polluted gas fills the segment(s) and then flows through a peripheral opening to a segmented upper section where it passes through a combustion chamber. At the combustion chamber the polluted gas is cleansed to form outgoing gas. From the combustion chamber, the cleansed gas flows through a heat exchanger and back to a center section segment(s). In the center section the cleansed gas flows to the rotary distributor where it is divided into outgoing and purge gases. The outgoing gas flows through the rotor to a manifold and then to an outlet. The purge gas meanwhile flows through a purge segment in the rotor to a center discharge pipe where it is directed to a conduit for exiting the RTO. The purge gas is then recycled with the incoming gas to the RTO.

The combustion chamber of the RTO operates on fuel oil or natural gas. Given the volatile price of fuel oil, natural gas is seen as the most economical way of operating the combustion chamber. Natural gas, however, is also subject to price fluctuation. It is for this reason that a system that would allow for a reduction in the amount of natural gas used in the combustion process would be an important improvement in the art.

BRIEF SUMMARY OF THE INVENTION

The present invention provides a system and method for cleaning industrial waste gas in an RTO. An improved RTO is also disclosed. The RTO may be, for example, a known type that has a rotary distributor, a center section above the rotary distributor, a heat exchanger section above the center section, and a combustion chamber above the heat exchanger. According to an aspect of the invention, the system introduces natural gas into portions of the center section in a sequenced manner via cycling on/off control valves. In a particular embodiment, the natural gas is injected at a specific location that is past the rotary distributor seals and directly under the bottom of the heat exchanger bed. According to the injection sequence, the injection of natural gas into the appropriate sectors commences when the sector begins to receive inlet waste gas streams, and injection ceases before the flow through the sector changes or stops. In an embodiment, each injection cycle may last a predetermined time.

The natural gas is directly injected and mixes into polluted waste gas streams monitored by the system as it passes up through the center section toward the upper heat exchanger section. The natural gas and most of the polluted air combust in the upper heat exchanger section, prior to reaching the combustion chamber. The result is a savings in energy in the combustion chamber by reducing the natural gas and combustion air required to maintain a setpoint temperature. Furthermore, the Nitrous Oxide ($NO_x$) generated by the main burner can be eliminated or greatly reduced as this burner is shut off or operates at a reduced firing rate. The natural gas injection system generates little or no $NO_x$ as it follows the principle of flameless oxidation. After passing through the combustion chamber, the treated air stream passes down through the heat exchanger section, past a monitored segment of the central section which will not allow natural gas to be injected in the down flow, through a rotary distributor that confirms by pressure that the stream is in down flow, and past a final gas monitor on the outlet confirming no gas leaks to the environment.

DETAILED DESCRIPTION OF THE INVENTION

Figure 1:
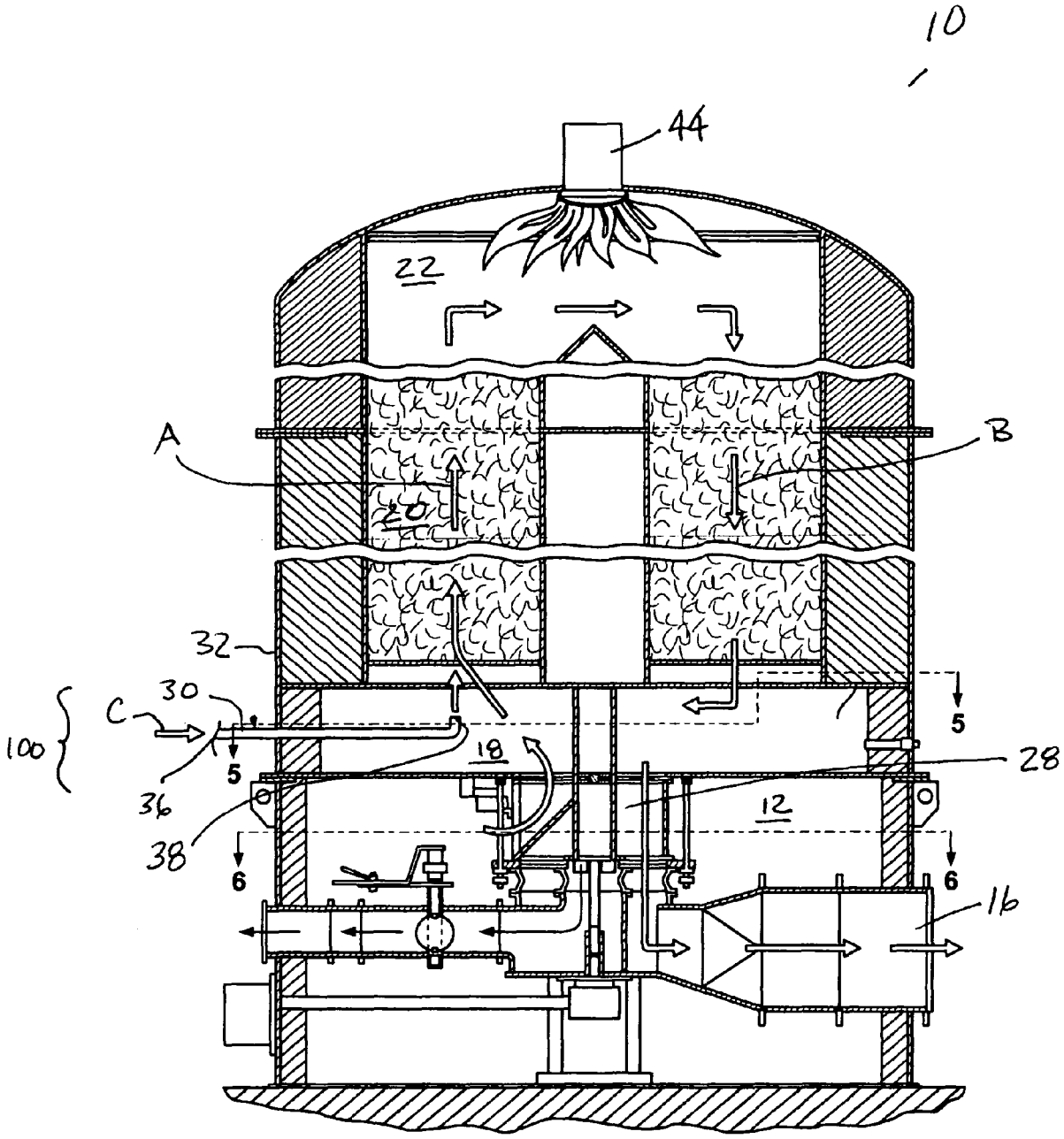
FIG. 1 a cross-sectional side view of an RTO having a nozzle for injecting natural gas into the center section in accordance with teachings of the present invention.
Figure 2:
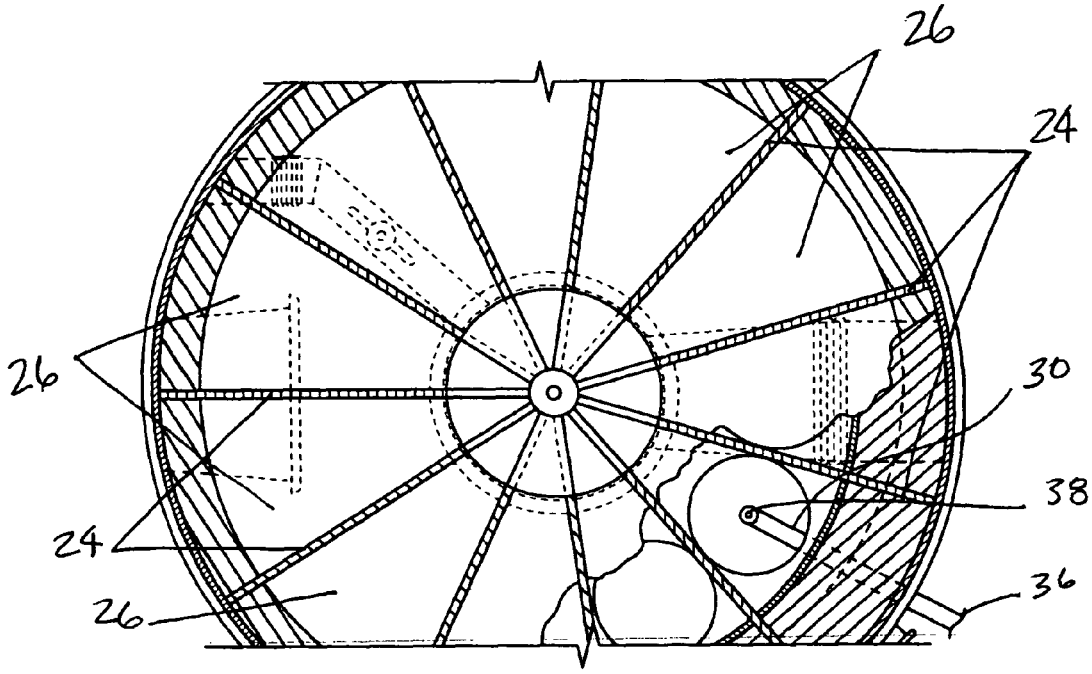
FIG. 2 is a cross-section as viewed generally along line 5-5 of FIG. 1, showing one of the natural gas injection nozzles in the center section.
Figure 3:
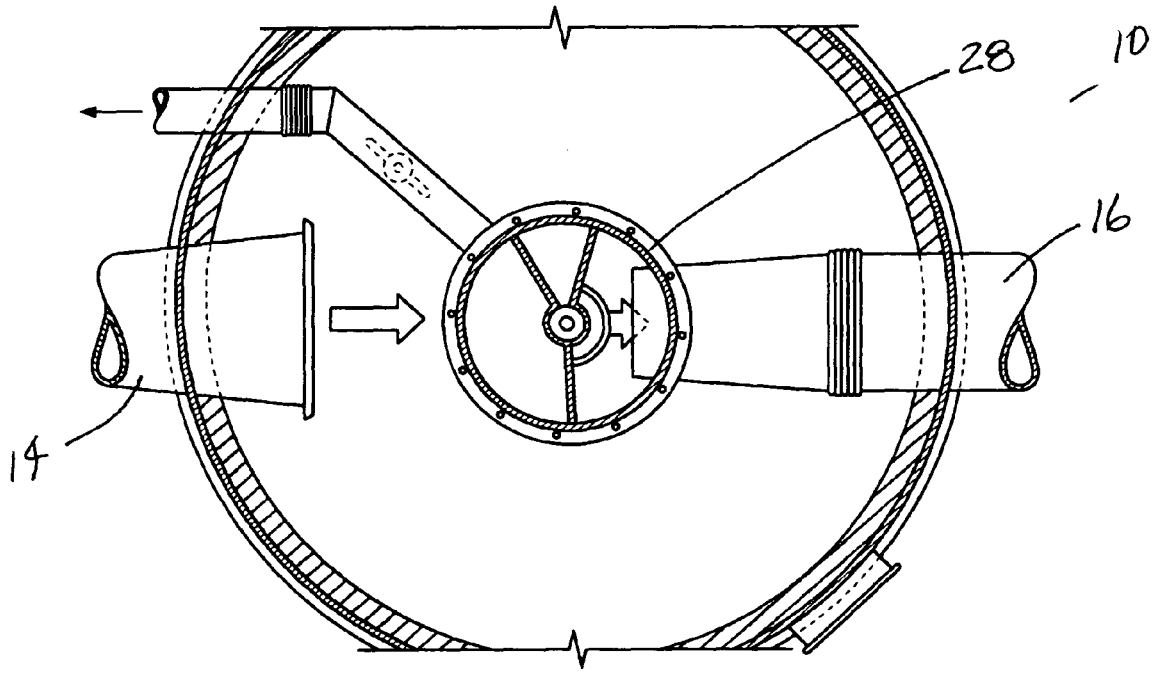
FIG. 3 is a cross-section as viewed generally along line 6-6 of FIG. 1.

The following examples further illustrate the invention but, of course, should not be construed as in any way limiting its scope. Referring to the drawings, FIGS. 1-3 illustrate a regenerative thermal oxidizer ("RTO") 10, a general description of which can be found in U.S. Pat. No. 5,562,442, incorporated herein by reference. Referring to FIG. 1 the RTO 10 generally includes a lower section 12 containing an inlet 14, as shown in FIG. 3, and an outlet 16. A center section 18 is located above the lower section 12 and a bed of heat exchanger material 20 is positioned vertically above the center section 18. An upper combustion chamber 22 is located above the heat exchanger bed 20. Turning to FIG. 2, the center section 18 includes a plurality of centrally intersecting walls 24 that divide the center section 18 into a plurality of wedge-shaped chamber segments 26.

As will be understood to those of ordinary skill in the art, the RTO 10 also includes a rotary distributor 28 that directs flow from the lower section 12 upwardly through the wedge shaped segments 26, as shown in FIG. 3. At any given time, the distributor 28 delivers an upward flow of polluted gases A, as shown in FIG. 1, to only some of the segments 26 depending on the present angular position of the distributor 28. At the same time, a downward exit flow B is delivered through some of the oppositely positioned segments 26, as shown in FIG. 1. As the distributor 28 rotates, upward flow A is delivered sequentially through segments 26 of the center section 18. The rate of rotation of the rotary distributor 28 may vary depending on the design and particular application of the RTO 10, however as an example, distributors 28 are known in which one rpm is an appropriate rate of rotation. As will also be recognized to those of ordinary skill in the art, the number of segments 26 in the center section 18 may vary depending on the design and application of the RTO 10.

Figure 4:
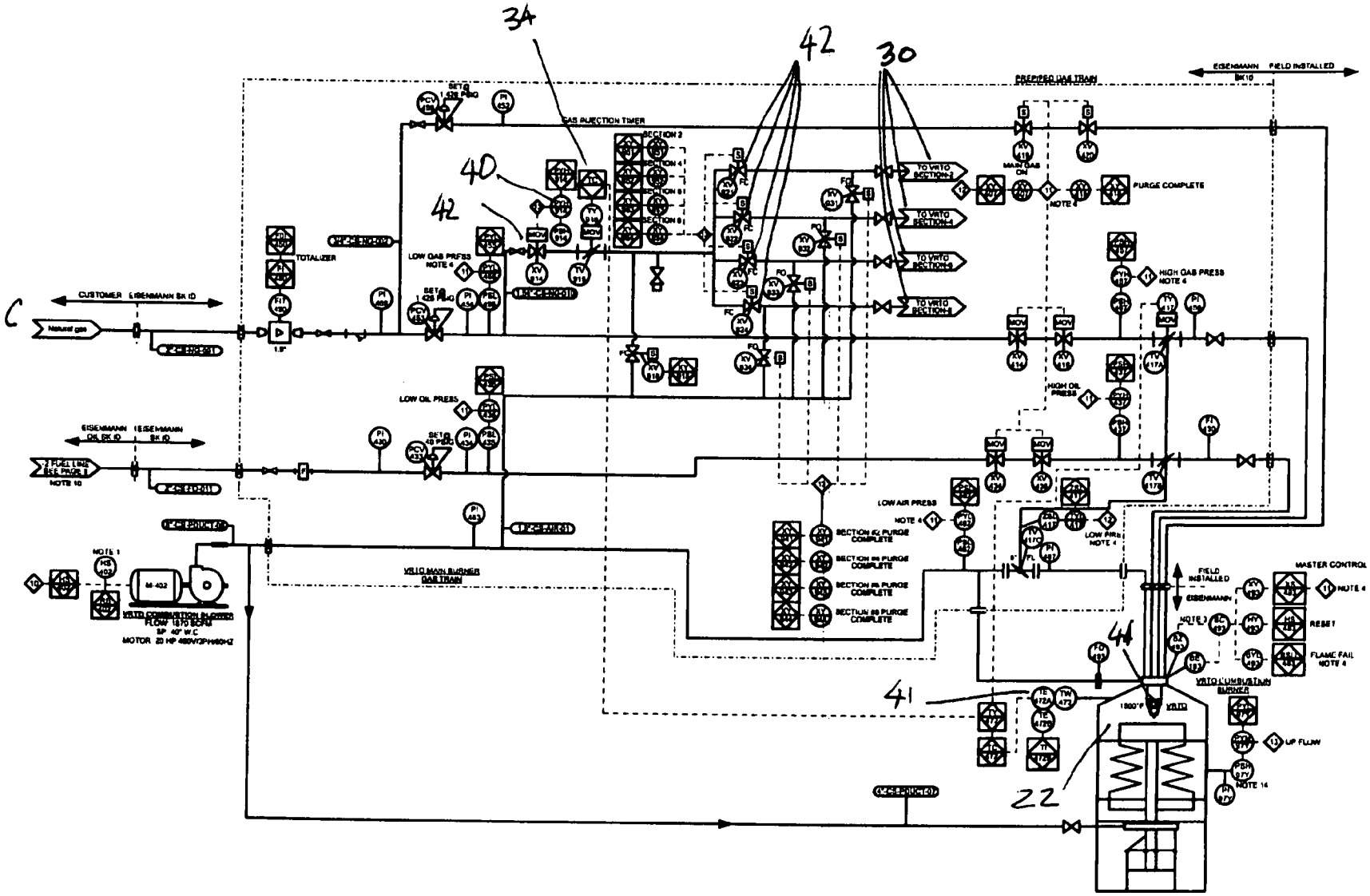
FIG. 4 is a schematic diagram of a natural gas injection system constructed in accordance with teachings of the present invention.
Figure 5:
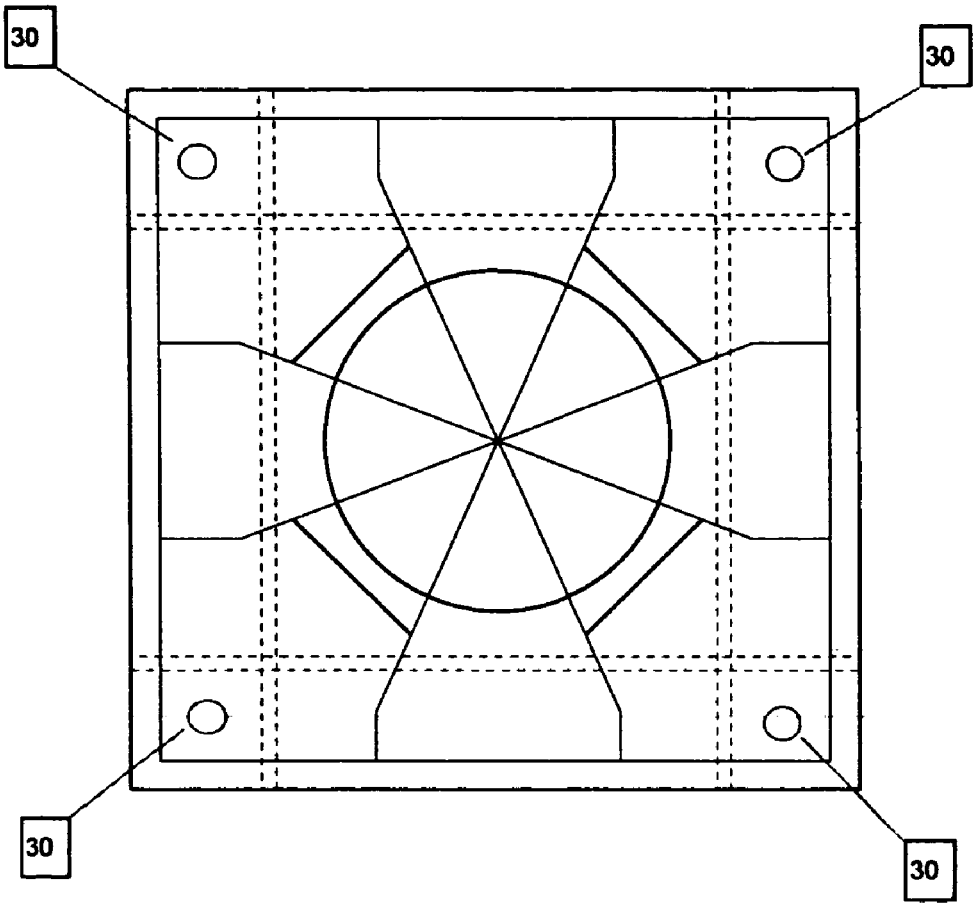
FIG. 5 is a cross-sectional view of the center section of the RTO showing four natural gas injection nozzles extending into the section.
Figure 6:
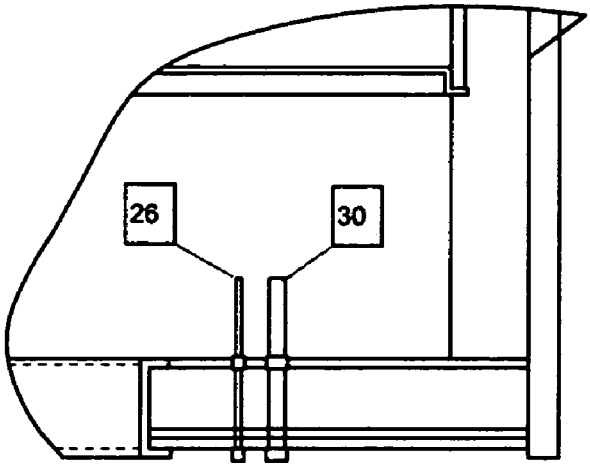
FIG. 6 is an elevation view showing a natural gas injection nozzle extending through a side wall of an RTO.

The invention involves a system 100 for cleaning industrial waste gas using a regenerative thermal oxidizer 10. As shown in FIGS. 1, 4, 5, and 6, the system 100 is comprised of a natural gas injection nozzle 30 located in a side wall 32 of the regenerative thermal oxidizer 10 upstream of a combustion chamber 22. The natural gas injection nozzle 30 is in flow communication with a supply of natural gas C, and a control valve 34 is connected to the natural gas injection nozzle 30, as shown in FIG. 4.

In an embodiment of the invention, the natural gas injection nozzle 30 extends between a first end 36 and a second end 38. As seen in FIGS. 1 and 2, the first end 36 of the nozzle 30 is positioned outside of the regenerative thermal oxidizer 10 and is in flow communication with the supply of natural gas C, and the second end 38 of the nozzle 30 is positioned inside of the regenerative thermal oxidizer 10.

As shown in FIG. 1, the regenerative thermal oxidizer 10 includes a lower section 12 housing a rotary distributor 28, a center section 18 located above the rotary distributor 28, a heat exchanger section 20 above the center section 18, and a combustion chamber 22 above the heat exchanger 20. In one embodiment of the invention, the natural gas injection nozzle 30 is positioned in the center section 18. In a particular embodiment, the natural gas injection nozzle 30 is positioned downstream of the rotary distributor 28 and directly under a bottom of the heat exchanger 20.

As shown in FIG. 4, the system 100 also includes a pressure limit switch 40 that monitors pressure of the natural gas supply. In addition, the system 100 may be further comprised of an automatic block valve 42 in flow communication with the supply of natural gas upstream of the natural gas injection nozzle 30. When in operation, the control valve 34 controls the flow of the supply of natural gas, thereby maintaining a constant temperature in the combustion chamber 22 of the regenerative thermal oxidizer 10.

Figure 7:
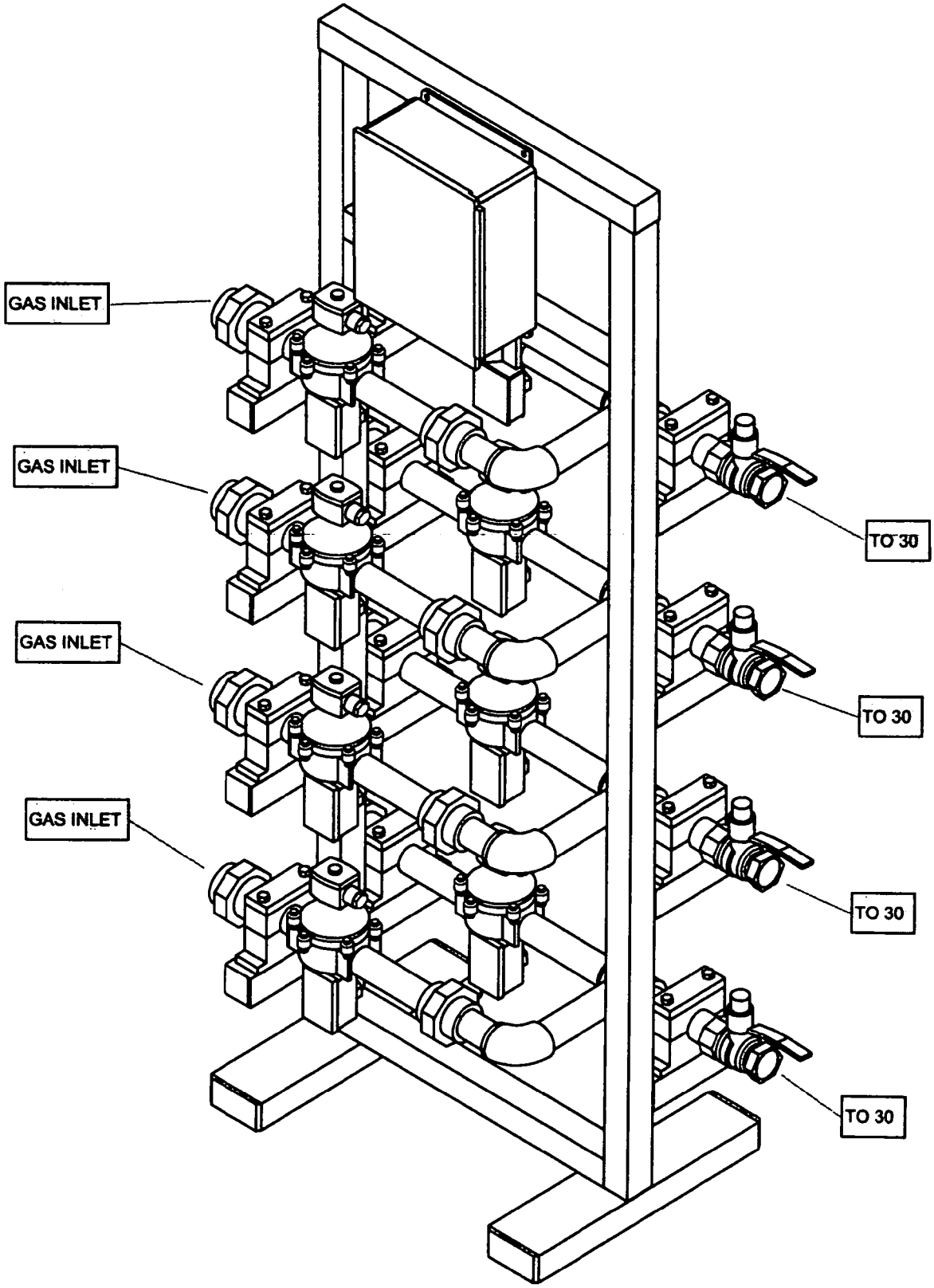
FIG. 7 is a perspective view showing a plurality of natural gas inlet lines.
Figure 8:
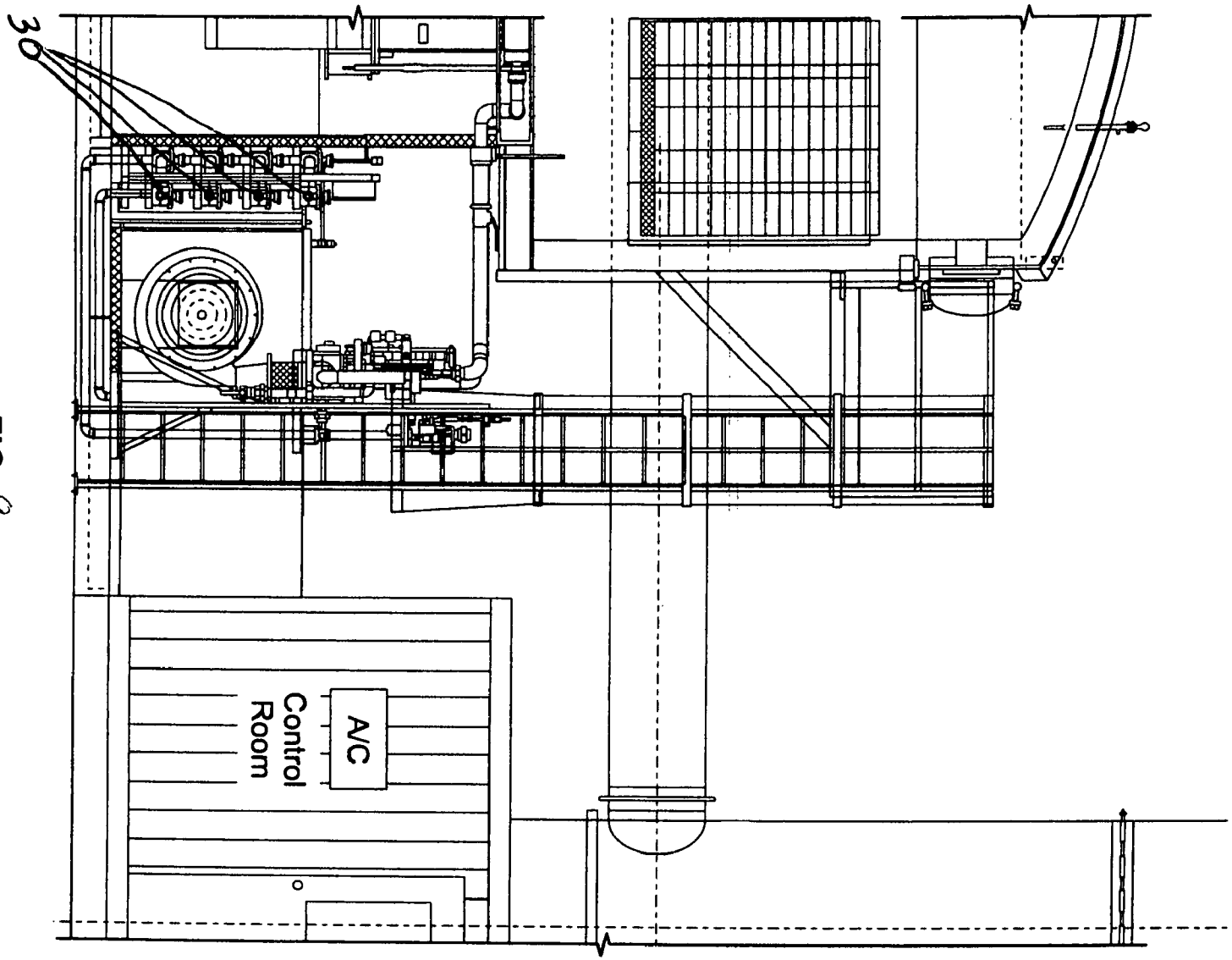
FIG. 8 is an elevation view of an RTO showing the piping of the natural gas injection system.

In still another embodiment of the invention, as shown in FIGS. 7 and 8, a plurality of natural gas injection nozzles 30(*a*)-(*d*) are located in the side of the regenerative thermal oxidizer 10. In this embodiment, an automatic block valve 42 is connected to each of the plurality of natural gas injection nozzles 30. These block valves 42 are also electrically connected to one another such that only one of the automatic block valves 42 may be opened at a given time.

Figure 9:
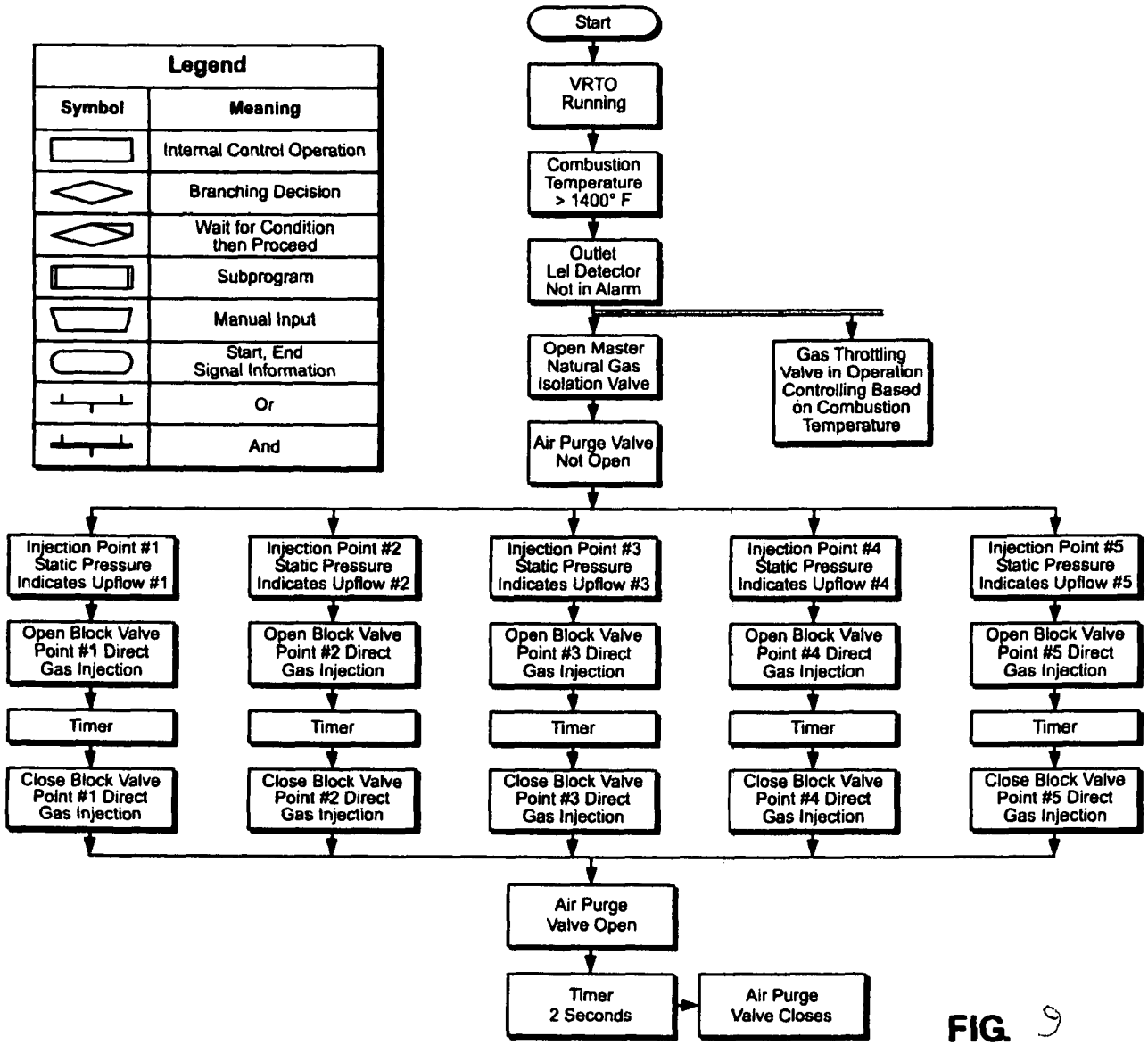
FIG. 9 is a schematic block diagram representing logic to control natural gas injection into angularly incremental segments of the center section of an RTO.

As shown in FIG. 9, the invention also involves a method for cleaning industrial waste gas using a regenerative thermal oxidizer 10 having a heat exchanger 20 and a combustion chamber 22. The method comprises: (a) providing a natural gas injection nozzle 30 in a section of the regenerative thermal oxidizer 10 upstream of the heat exchanger 20; (b) injecting natural gas through the natural gas injection nozzle 30 into a flow of contaminated air passing through the section of the regenerative thermal oxidizer 10; and (c) passing the flow of contaminated air including the injected natural gas through the heat exchanger 20.

In an embodiment, the inventive method may also include mixing the injected natural gas with the contaminated air and heat in the heat exchanger 20, thereby causing the injected natural gas to reach combustion temperature while in the heat exchanger 20. Additionally, the method may include generating a flameless oxidation of the natural gas and the contaminated air, thereby releasing heat within the heat exchanger 20 without generating thermal $NO_x$ emissions. Furthermore, the invention may involve passing the heat released from the combustion of the natural gas in the heat exchanger 20 into the combustion chamber 22, thereby reducing the amount of heat required to be generated by a burner 44 located in the combustion chamber 22. In still another embodiment, the inventive method is performed when the temperature in the combustion chamber 22 is at least 1,400° F.

According to an aspect of the invention, natural gas is injected into the center section 18 of the RTO 10 in a controlled manner whereby the injection is sequenced among certain wedge-shaped segments 26 during upward flow of intake waste gas A moving toward the heat exchanger 20 and the combustion chamber 22. The injection is controlled by cycling on/off control valves 34 that affect flow to injector nozzles 30 mounted within the center section 18. The natural gas is injected in the center section 18, which is advantageously located past the rotary distributor seals 28 and directly under the bottom of the heat exchanger bed 20. The natural gas injection sequencing in the appropriate segment 26 begins when a the segment 26 starts receiving inlet waste gas streams and is timed and stopped shutting off the natural gas flow prior to the sector flow direction changing or stopping.

Referring to FIGS. 1, 2, 5, 6 and 8, the RTO 10 is equipped with a plurality of injection nozzles 30(*a*)-(*d*) that are mounted to deliver natural gas into a respective one of the wedge-shaped segments 26 of the center section 18. In an embodiment, nozzles 30 are provided at selected segments 26 spaced at preferably even angular increments. For example, in the embodiment of FIGS. 5 and 8, wherein the center section 18 is divided into eight segments 26, the system includes four injection nozzles 30 mounted within every other one of the respective segments 26. In the embodiment of FIGS. 1 and 2, in which the center section 18 is divided into eleven segments 26, the RTO 10 may be equipped with five nozzles 30 mounted at staggered increments.

In order to achieve desired results, the system 100 controls the injection of natural gas from certain injectors 30 under certain conditions. A programmable logical controller (PLC) may be used to control the natural gas flow among the plurality of injectors 30 according to various inputs. Generally, the system 100 causes gas to be injected into segments 26 that are experiencing an upflow (as dictated by the angular position of the rotary distributor 20) if the temperature of the combustion chamber 22 is at least an appropriate level. Several control parameters dictate when injection is appropriate. FIG. 9 is a schematic block diagram that discloses logic for controlling a system 100 having five natural gas injectors 30(*a*)-(*d*).

The system 100 senses the direction of flow through the respective segments 26 equipped with natural gas injection nozzles 30. More particularly, for example, the system 100 includes a plurality of pressure sensors, each of which detects the pressure within the corresponding segment 26 and sends a corresponding signal to a controller. Because the segment is known to experience a higher pressure during upflow than in downflow, the controller can determine when the pressure detected by sensor corresponds to an upflow condition. The controller is effective to actuate a valve that selectively delivers a flow of natural gas to the injector 30 corresponding to the segment 26.

In order to only inject natural gas in appropriate combustion conditions, a temperature sensor 41 is provided to detect the temperature in the combustion chamber 22. The temperature sensor sends a signal to the controller, and the controller permits injection through a nozzle 30 during an up flow in a corresponding segment 26 only if the combustion chamber 22 temperature exceeds a predetermined minimum temperature, e.g., 1,400° F. Such a temperature will ensure that upper regions of the heat exchanger bed 20 are sufficiently hot to facilitate the desired reaction.

The injection is also controlled in a manner so that at the process air flowing upwardly through the center section 18 is mixed with gas from at least one of the nozzles 30 at any given time. An injection cycle for an individual nozzle 30 may be programmed to deliver a flow of natural gas into the corresponding segment 26 for a time period designed to achieve this. For example, when injection commences through one of the nozzles 30, the controller continues to maintain delivery of natural gas for a predetermined time period (e.g. 14 seconds) which is appropriately determined according to the number of nozzles 30, relative angular spacing of the nozzles 30 within the segmented center section 18, the rate of angular motion of the rotational distributor 20, and the angular range of intake flow delivery from the distributor 20 to the center section 18. Ideally, the period of injection of a particular nozzle 30 overlaps with the respectively adjacent nozzles 30 that are sequentially before and after.

The natural gas is directly injected and mixes with polluted waste gas streams A monitored by the system as passing up through the center section 18 toward the upper heat exchanger section 20, as shown in FIG. 1. The natural gas and most of the polluted air combust in the upper heat exchanger section 20, prior to reaching the combustion chamber 22. The result is a saving in energy in the combustion chamber 22 by reducing the natural gas and combustion air required to maintain a setpoint temperature. Furthermore, the $NO_x$ generated by the main burner 44 can be eliminated or greatly reduced as this burner 44 is shut off or operates at a reduced firing rate. The natural gas injection system 100 generates little or no $NO_x$ as it follows the principle of flameless oxidation. The treated air stream B passes down through the heat exchanger section 20, past a monitored segment of the central section 26 which will not allow gas injection in the down flow, through a rotary distributor 20 that confirms by pressure that the stream is in down flow, and past a final gas monitor on the outlet 16 confirming no gas leaks to environment.

Process

The direct gas injection system 100 mixes natural gas with process air in a valveless regenerative thermal oxidizer (VRTO) 10, prior to the gas reaching the upper heat exchanger media 20. The gas is introduced after the rotary distributor 28 to prevent concerns of gas leakage to the treated air section of the VRTO 10. The upper heat exchanger media 20 provides a static surface that allows good mixing of the natural gas with air, and sufficient heat such that the natural gas reaches combustion temperature in the midst of the heat exchanger media 20, using free oxygen present in the air stream A being treated. The result is a flameless oxidation that releases energy within the heat exchanger media 20 without generating thermal $NO_x$ emissions. The heat released by the combustion of the natural gas in the thermal heat exchange media 20 supplants the requirements of the burner 44 in the combustion chamber 22 including most importantly the required combustion air requirement. The reduction in combustion air supplied results in the total natural gas consumption required for the entire RTO 10 to be reduced by 20-25% in comparison to the conventional state of the art for such devices based on standard burner technology.

Control

In an embodiment, the direct gas injection system 100 is preferably controlled to only supply natural gas to mix with process air requiring treatment in sectors of the vessel 10 above the rotary distributor 28 and below the heat exchanger media 20 in which the flow A is moving upwards through the heat exchanger media 20 toward a combustion chamber 22 with at least a temperature of 1,400° F. Any condition not proven to meet the above criteria is considered unsafe and the system 100, via hardwired safety valves, will prevent introduction of natural gas into the vessel 10.

In a specific embodiment, the system 100 may include the following elements. A natural gas automatic block valve 42, which requires all-safe criteria in order to open to allow natural gas entry to the direct gas system. A pressure limit switch 40 monitors the natural gas line pressure to assure the natural gas line pressure is safe for utilization. Next is a control valve 34 which when in the natural gas injection is operated, acts to control the flow of gas in order to maintain a constant temperature in the RTO 10 combustion chamber 22 based on a preset temperature setpoint. Following the control valve 34 is a manifold of individual on/off block valves 42 each representing a direct gas injection connection 30 to the RTO 10. These valves are wired such that only one block valve 42 is allowed open at any one time. The criteria for opening one of these block valves 42 is determined by a differential pressure switch monitoring the pressure difference at each direct natural gas injection point 30. Only airflow A moving up towards the upper heat exchanger material 20 will create sufficient air pressure to energize the differential pressure switch. The energized switch will allow the individual on/off block valve 42 associated with the given injection point 30 to be energized, and will start a hardwired timer which will allow the on/off solenoid to stay open for only a pre-selected time period. As gas is injected, the throttling control valve 34 will modulate gas flow as necessary to maintain constant temperature as registered in the combustion chamber 22. The differential pressure switch must stay energized during the entire period in order for the block valve 42 to stay open. At the end of the timed period, the natural gas on/off injection point will close, and a common combustion air purge valve will open to purge any remaining natural gas into the RTO vessel for oxidation. A separate hardwired timer sets the purge time. Another direct gas injection on/off block valve 42 will only open if no other block valve 42 is open and the above criteria are satisfied. None of the direct gas injection valves 42 will be allowed to open or remain open if the combustion chamber temperature is not at least at 1,400 F. None of the direct gas injection valves 42 will be allowed to open or remain open if the Lower Explosive Limit (LEL) detector on the outlet of the RTO exceeds 20%. The common block and individual on/off valves for the various direct gas injection ports 30 are all hardwired via relay to the described system safeties, so no operator intervention is required to place the system 100 in a fail-safe condition.

The above sequence of operation has been found to provide energy savings, low $NO_x$, and sequence of operation.

The invention also involves an improved regenerative thermal oxidizer 10 having a lower section 12 that includes an inlet 14 to receive incoming industrial waste gas, a centrally positioned rotary distributor 28 in the lower section 12 for controlling the waste gas flow via a segmented center section, a center section 18 above the rotary distributor 28, a heat exchanger section 20 above the center section 18, and a combustion chamber 22 above the heat exchanger 20, the improvement, as shown in FIG. 1, is comprised of a natural gas injection nozzle 30 located in a side wall 32 of the regenerative thermal oxidizer 10 upstream of the combustion chamber 22, the natural gas injection nozzle 30 in flow communication with a supply of natural gas, and a control valve 34 connected to the natural gas injection nozzle 30.

In an embodiment, of the improved regenerative thermal oxidizer 10, the natural gas injection nozzle 30 extends between a first end 36 and a second end 38. The first end 36 of the nozzle is positioned outside of the regenerative thermal oxidizer 10 and is in flow communication with the supply of natural gas, and the second end 38 of the nozzle 30 is positioned inside of the regenerative thermal oxidizer 10. In still another embodiment, the natural gas injection nozzle 30 is positioned in the center section 18.

In yet another embodiment of the improved RTO 10, the natural gas injection nozzle 30 is positioned downstream of the rotary distributor 28 and directly under a bottom of the heat exchanger 20.

The supply of natural gas is provided to the improved RTO 10 under a given pressure and a pressure limit switch 40 monitors the pressure of the supply of natural gas. An automatic block valve 42 is in flow communication with the supply of natural gas upstream of the natural gas injection nozzle 30. Additionally, the control valve 34 controls the flow of the supply of natural gas, thereby maintaining a constant temperature in the combustion chamber 22 of the regenerative thermal oxidizer 10.

In still another embodiment of the improved regenerative thermal oxidizer 10, a plurality of natural gas injection nozzles 30 are located in the side wall 32 of the RTO 10, as shown in FIGS. 4 8. In this embodiment, an automatic block valve 42 is connected to each of the plurality of natural gas injection nozzles 30. These automatic block valves 42 are also electrically connected to one another such that only one of the automatic block valves 42 may be opened at a given time.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

The invention claimed is:

1. A system for cleaning industrial waste gas using a regenerative thermal oxidizer, the system comprised of:

a plurality of natural gas injection nozzles located in a side wall of the regenerative thermal oxidizer upstream of a combustion chamber, each of the natural gas injection nozzles in flow communication with a supply of natural gas; and a control valve connected to each of the natural gas injection nozzles, wherein:

the regenerative thermal oxidizer includes a lower section housing a rotary distributor, a center section located above and downstream from the rotary distributor, a heat exchanger section above and downstream from the center section, and a combustion chamber above and downstream from the heat exchanger; and each one of the plurality of natural gas injection nozzles is positioned in the center section.

2. The system of claim 1, wherein:

each natural gas injection nozzle extends between a first end and a second end;

the first end of each nozzle is positioned outside of the regenerative thermal oxidizer and is in flow communication with the supply of natural gas; and the second end of each nozzle is positioned inside of the regenerative thermal oxidizer.

3. The system of claim 1, wherein each natural gas injection nozzle is positioned downstream of the rotary distributor and directly under a bottom of the heat exchanger.

4. The system of claim 1 further comprised of a pressure limit switch that monitors pressure of the natural gas supply.

5. The system of claim 1 further comprised of an automatic block valve in flow communication with the supply of natural gas upstream of each natural gas injection nozzle.

6. The system of claim 1, wherein the control valve controls the flow of the supply of natural gas, thereby maintaining a constant temperature in a combustion chamber of the regenerative thermal oxidizer.

7. The system of claim 1, wherein:

an automatic block valve is connected to each of the plurality of natural gas injection nozzles; and the automatic block valves connected to each of the plurality of natural gas injection nozzles are electrically connected to one another such that only one of the automatic block valves may be opened at a given time.

8. A method for cleaning industrial waste gas, the method comprising:

providing a regenerative thermal oxidizer having a rotary distributor, a heat exchanger and a combustion chamber;

providing a plurality of natural gas injection nozzles in a section of the regenerative thermal oxidizer upstream of the heat exchanger and downstream of the rotary distributor;

injecting natural gas through each natural gas injection nozzle into a flow of contaminated air passing through the section of the regenerative thermal oxidizer; and passing the flow of contaminated air including the injected natural gas through the heat exchanger.

9. The method of claim 8 further comprising:

mixing the injected natural gas with the contaminated air and heat in the heat exchanger, thereby causing the injected natural gas to reach combustion temperature while in the heat exchanger.

10. The method of claim 8 further comprising:

generating a nameless oxidation of the natural gas and the contaminated air, thereby releasing heat within the heat exchanger without generating thermal $NO_x$ emissions.

11. The method of claim 10 further comprising:

passing the heat released from the combustion of the natural gas in the heat exchanger into the combustion chamber, thereby reducing the amount of heat required to be generated by a burner located in the combustion chamber.

12. The method of claim 8, wherein a temperature in the combustion chamber is at least 1,400° F.

13. An improved regenerative thermal oxidizer having a lower section that includes an inlet to receive incoming industrial waste gas, a centrally positioned rotary distributor in the lower section for controlling the waste gas flow via a segmented center section, a center section located above and downstream from the rotary distributor, a heat exchanger section above and downstream from the center section, and a combustion chamber above and downstream from the heat exchanger, the improvement comprised of:

a plurality of natural gas injection nozzles located in a side wall of the regenerative thermal oxidizer upstream of the combustion chamber, each natural gas injection nozzle in flow communication with a supply of natural gas; and a control valve connected to each natural gas injection nozzle, wherein each one of the plurality of natural gas injection nozzles are positioned in the center section.

14. The improved regenerative thermal oxidizer of claim 13, wherein:

each natural gas injection nozzle extends between a first end and a second end;

the first end of each nozzle is positioned outside of the regenerative thermal oxidizer and is in flow communication with the supply of natural gas; and the second end of each nozzle is positioned inside of the regenerative thermal oxidizer.

15. The improved regenerative thermal oxidizer of claim 13, wherein each natural gas injection nozzle is positioned downstream of the rotary distributor and directly under a bottom of the heat exchanger.

16. The improved regenerative thermal oxidizer of claim 13, wherein:

the supply of natural gas is provided under a given pressure; and a pressure limit switch monitors the pressure of the supply of natural gas.

17. The improved regenerative thermal oxidizer of claim 13, wherein an automatic block valve is in flow communication with the supply of natural gas upstream of the each natural gas injection nozzle.

18. The improved regenerative thermal oxidizer of claim 13, wherein the control valve controls the flow of the supply of natural gas, thereby maintaining a constant temperature in the combustion chamber of the regenerative thermal oxidizer.

19. The improved regenerative thermal oxidizer of claim 13, wherein:

an automatic block valve is connected to each of the plurality of natural gas injection nozzles; and the automatic block valves connected to each of the plurality of natural gas injection nozzles are electrically connected to one another such that only one of the automatic block valves may be opened at a given time.

* * * * *